US009478180B2

(12) United States Patent
Huang

(10) Patent No.: US 9,478,180 B2
(45) Date of Patent: Oct. 25, 2016

(54) SIGNAL PROCESSING METHOD

(75) Inventor: Shunming Huang, Shandong (CN)

(73) Assignee: Hisense Electric Co., Ltd. (CN)

( * ) Notice: Subject to any disclaimer, the term of this patent is extended or adjusted under 35 U.S.C. 154(b) by 384 days.

(21) Appl. No.: 14/125,631

(22) PCT Filed: Jun. 20, 2012

(86) PCT No.: PCT/CN2012/077179
§ 371 (c)(1),
(2), (4) Date: Dec. 12, 2013

(87) PCT Pub. No.: WO2013/189036
PCT Pub. Date: Dec. 27, 2013

(65) Prior Publication Data

US 2015/0170587 A1 Jun. 18, 2015

(51) Int. Cl.
*G09G 3/36* (2006.01)

(52) U.S. Cl.
CPC ..... *G09G 3/3611* (2013.01); *G09G 3/3614* (2013.01); *G09G 2310/0205* (2013.01); *G09G 2310/0224* (2013.01); *G09G 2310/0248* (2013.01); *G09G 2330/023* (2013.01)

(58) Field of Classification Search
CPC ..... G09G 2310/0224; G09G 3/3611; G09G 2310/0205; G09G 2310/0248; G09G 2330/023; G09G 3/3614
See application file for complete search history.

(56) References Cited

U.S. PATENT DOCUMENTS

2008/0278429 A1* 11/2008 Chen ..... G09G 3/3655 345/98
2009/0146934 A1 6/2009 Hong et al.
2010/0188374 A1 7/2010 Chen et al.
2011/0134092 A1 6/2011 Lee et al.

FOREIGN PATENT DOCUMENTS

CN 2561046 Y 7/2003
CN 102460971 A 5/2012
GB 2 326 013 12/1998
JP 2001-133754 5/2001

(Continued)

OTHER PUBLICATIONS

International Search Report dated Dec. 27, 2012 from corresponding International Patent Application No. PCT/CN2012/077179 along with English translation.

(Continued)

*Primary Examiner* — Alexander Eisen
*Assistant Examiner* — Abhishek Sarma
(74) *Attorney, Agent, or Firm* — DLA Piper LLP (US)

(57) ABSTRACT

The present application discloses a signal processing method, which is applied to an electronic apparatus provided with or externally connected with a liquid crystal display device, where the method includes: receiving a polarity control signal; obtaining a first correspondence relationship between the polarity control signal and a drive mode in the liquid crystal display device according to the polarity control signal; creating a truth table corresponding to the first correspondence relationship according to the first correspondence relationship; and determining a drive signal corresponding to the drive mode according to the truth table, wherein the drive signal includes a first drive signal and a second drive signal.

16 Claims, 7 Drawing Sheets

(56) References Cited

FOREIGN PATENT DOCUMENTS

| | | |
|---|---|---|
| JP | 2005-215591 | 8/2005 |
| JP | 2006-343563 | 12/2006 |

OTHER PUBLICATIONS

Supplementary European Search Report dated May 26, 2015 of corresponding European Application No. 12876588.0.

* cited by examiner

| | First charge sharing time | Secondcharge sharing time | Third charge sharing time |
|---|---|---|---|
| 1 line | 60 clk | 60 clk | 60 clk |
| 2 line | 70 clk | 50 clk | 70 clk |
| 1+2line | 50 clk | 70 clk | 50 clk |

Fig.4A

| | Frame1 | Frame2 | Frame3 |
|---|---|---|---|
| | POL1 | POL2 | POL3 |
| 1 Line | 1 | 0 | 1 |
| | 0 | 1 | 0 |
| 2 Line | 1 | 1 | 0 |
| | 0 | 0 | 1 |
| 1+2 Line | 1 | 0 | 0 |
| | 0 | 1 | 1 |

Fig.4B

| | A | B | F1 |
|---|---|---|---|
| 1line | 1 | 0 | 1 |
| | 0 | 1 | 1 |
| 2line | 1 | 1 | 0 |
| | 0 | 0 | 0 |
| 1+2line | 1 | 0 | 1 |
| | 0 | 1 | 1 |

Fig.5

| | B | C | F2 |
|---|---|---|---|
| 1line | 0 | 0 | 1 |
| | 1 | 0 | 1 |
| 2line | 1 | 0 | 1 |
| | 0 | 1 | 0 |
| 1+2line | 0 | 0 | 0 |
| | 1 | 1 | 0 |
Fig.6
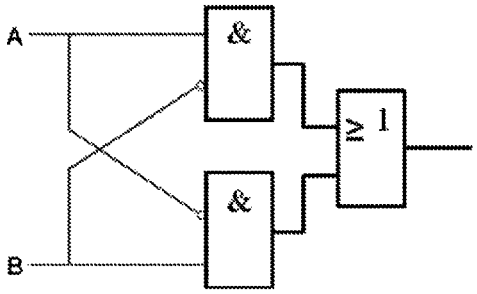
Fig.7
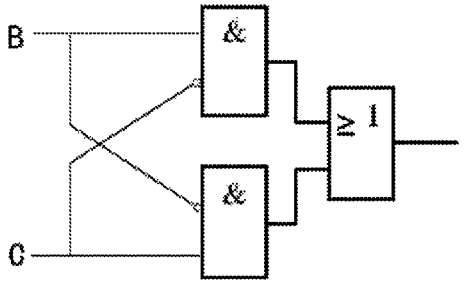
Fig.8

| | F1 | F2 |
|---|---|---|
| 1 line | 1 | 1 |
| 2 line | 0 | 1 |
| | 0 | 0 |
| 1+2line | 1 | 0 |
Fig.9
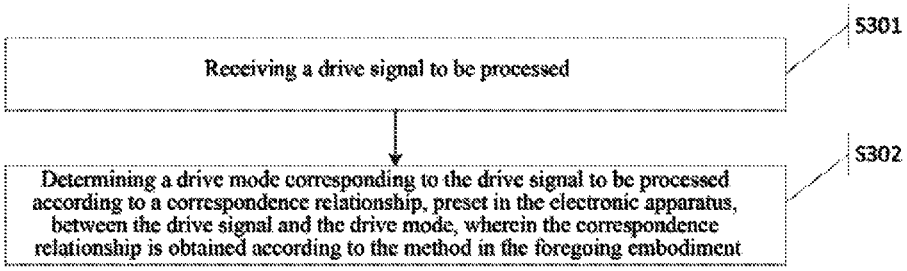
Fig.10
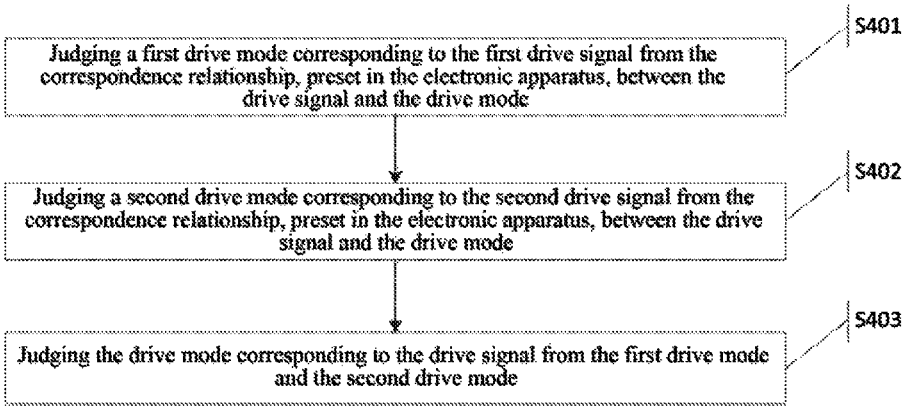
Fig.11

SIGNAL PROCESSING METHOD

This application is a US National Stage of International Application No. PCT/CN2012/077179, filed on 20 Jun. 2012, and designating the United States.

FIELD OF THE INVENTION

The present invention relates to the field of electronic technologies and particularly to a signal processing method.

BACKGROUND OF THE INVENTION

Typically, when a liquid crystal display device is used, the case of parity lines exists to a varying extent, and the parity lines are as shown in FIG. 1 where the liquid crystal display device is illustrated with the parity lines appearing to a varying extent at the bottom left and top right corners.

The parity lines appear because for example, there are 1024 rows of data in the liquid crystal display device when the liquid crystal display device is powered on, and the voltage of a data driver is rising when odd rows of data are turned on at an instant T1, and at this instant, the liquid crystal display device is not fully charged and the liquid crystal display device shows a darker picture; and when even rows of data are turned on at instants T3 and T4, the data driver can output a signal normally, the liquid crystal display device is fully charged, and the liquid crystal display device shows a brighter picture, so the liquid crystal display device shows pictures with bright-dark horizontal lines, i.e., parity lines, appearing due to the data driver.

Since the parity lines are an important factor to evaluate picture quality of the liquid crystal display device, how to solve the problem of parity lines has become an important issue in the field of electronic technologies.

In order to solve the foregoing problem, a method adopted in the prior art is to use a charge sharing mode in which when a liquid crystal display screen is scanned, adjacent rows and columns in the liquid crystal display device are made to charge each other by taking advantage of the characteristic that the adjacent rows and columns have opposite polarities, so that the adjacent rows and columns have the equal voltage and the same charging time, and thus the purpose of eliminating the parity lines is achieved.

The applicant has found, during implementing the application, at least the following technical problems in the prior art:

In the prior art, different liquid crystal display devices have different drive modes in which corresponding charge sharing modes are also different, and the use of the same charge sharing mode in the different drive modes still fails to solve the technical problem of parity lines appearing in the liquid crystal display device.

SUMMARY OF THE INVENTION

The invention provides a signal processing method so as to solve the technical problem of parity lines existing in the prior art.

In an aspect, the invention provides the following technical solution through an embodiment of the application:

A signal processing method is provided, which is applied to an electronic apparatus provided with or externally connected with a liquid crystal display device, and this method includes:

receiving a polarity control signal; obtaining a first correspondence relationship between the polarity control signal and a drive mode in the liquid crystal display device according to the polarity control signal; creating a truth table corresponding to the first correspondence relationship according to the first correspondence relationship; and determining a drive signal corresponding to the drive mode according to the truth table, wherein the drive signal comprises a first drive signal and a second drive signal.

In another aspect, the invention provides a method for determining a drive mode through another embodiment of the application, which is applied to an electronic apparatus and includes: receiving a drive signal to be processed; and determining a drive mode corresponding to the drive signal to be processed according to a correspondence relationship, preset in the electronic apparatus, between the drive signal and the drive mode, wherein the correspondence relationship is obtained as above.

In still another aspect, the invention provides an electronic apparatus through another embodiment of the application, which includes: a data drive module configured to receive a drive signal to be processed; and the data drive module further configured to determine a drive mode corresponding to the drive signal to be processed according to a correspondence relationship, preset in the electronic apparatus, between the drive signal and the drive mode, wherein the correspondence relationship is obtained as above.

In still another aspect, the invention provides a video playing apparatus through another embodiment of the application, which specifically include: a housing; a display screen arranged in the housing; a power supply device, connected with the display screen and configured to supply power to the display screen; and a drive device, connected with the display screen and the power supply device, and configured to receive a drive signal to be processed and to determine a drive mode in the display screen corresponding to the drive signal to be processed according to a correspondence relationship, preset in the drive device, between the drive signal and the drive mode, wherein the correspondence relationship is obtained as above.

One or more of the foregoing technical solutions have the following technical effects or advantages:

In the application, a correspondence relationship between drive modes and drive signals and a correspondence relationship between different drive modes and different charge sharing corresponding thereto are created in a series of methods, and a different drive signal can be analyzed upon reception of the drive signal to determine a corresponding drive mode, and then corresponding charging time for charge sharing can be used to thereby solve the technical problem of parity lines appearing in the liquid crystal display device.

BRIEF DESCRIPTION OF THE DRAWINGS

FIG. 4A is a schematic diagram of a correspondence relationship between drive modes and time required for charge sharing in the drive modes in an embodiment of the application;

FIG. 4B is a schematic diagram of a first correspondence relationship in an embodiment of the application;

FIG. 5 is a schematic diagram of a correspondence relationship between three different drive modes and a first drive signal in an embodiment of the application;

FIG. 6 is a schematic diagram of a correspondence relationship between three different drive modes and a second drive signal in an embodiment of the application;

FIG. 7 is a schematic diagram of a gate circuit of a first logic equation in an embodiment of the application;

FIG. 8 is a schematic diagram of a gate circuit of a second logic equation in an embodiment of the application;

FIG. 9 is a schematic diagram of a relationship between a first drive signal and a second drive signal in an embodiment of the application;

FIG. 10 is a flow chart of a method for determining a drive mode in an embodiment of the application;

FIG. 11 is a flow chart of determining a drive mode corresponding to a drive signal in an embodiment of the application;

DETAILED DESCRIPTION OF THE EMBODIMENTS

In order to solve the technical problem of parity lines appearing in the prior art, an embodiment of the invention provides a signal processing method with the following general idea of a solution thereof:

A specific correspondence relationship between different drive modes and charge sharing is created in a data driver, and then a drive mode corresponding to a drive signal is analyzed, and the data driver is charged by charge sharing corresponding to the drive mode, so that a charge sharing mode corresponding to a different drive mode can be selected to charge the data driver for different time, to thereby solve the technical problem of parity lines existing in a liquid crystal display device.

A general implementation principle and particular implementation process of embodiments of the invention and corresponding achievable advantageous effects thereof will be described below in details in connection with the drawings.

A signal processing method is provided, which is applied to an electronic apparatus provided with or externally connected with a liquid crystal display device.

Figure 1:
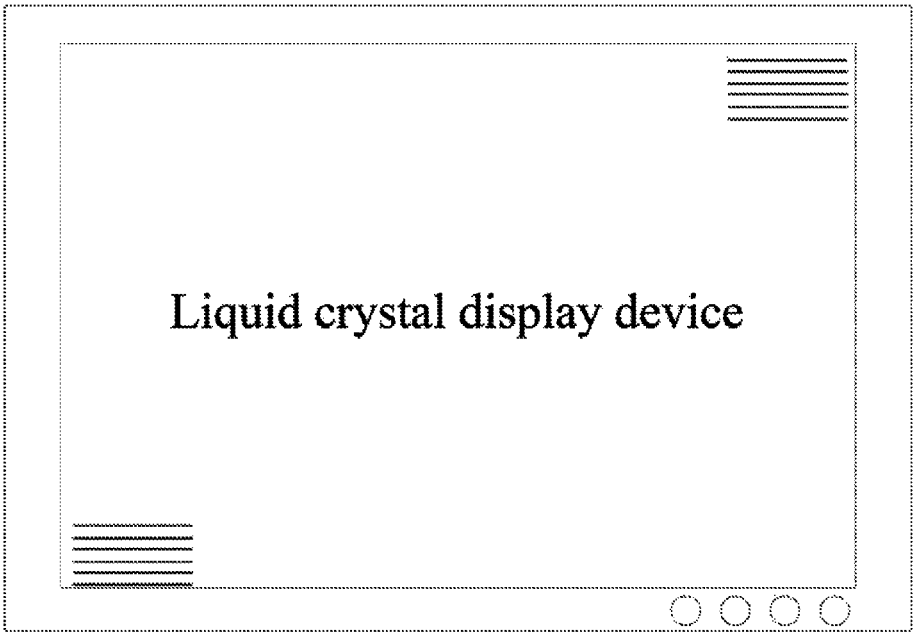
FIG. 1 is a schematic diagram of a liquid crystal display device with parity lines appearing in the prior art.
Figure 2:
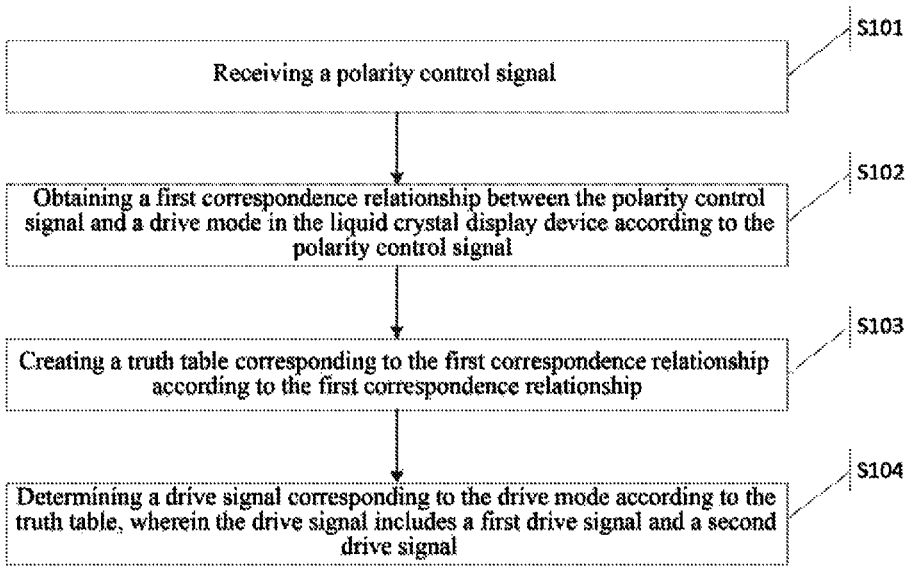
FIG. 2 is a flow chart of signal processing in an embodiment of the application.

Particular operation steps are as illustrated in FIG. 2, including the following steps:

S101, receiving a polarity control signal.

S102, obtaining a first correspondence relationship between the polarity control signal and a drive mode in the liquid crystal display device according to the polarity control signal.

S103, creating a truth table corresponding to the first correspondence relationship according to the first correspondence relationship.

S104, determining a drive signal corresponding to the drive mode according to the truth table, wherein the drive signal includes a first drive signal and a second drive signal.

In addition, the method further includes the step of determining a correspondence relationship between the drive mode and time required for charge sharing in the drive mode according to the polarity control signal.

Furthermore, the truth table particularly is a correspondence relationship between drive modes and drive signals.

Figure 3:
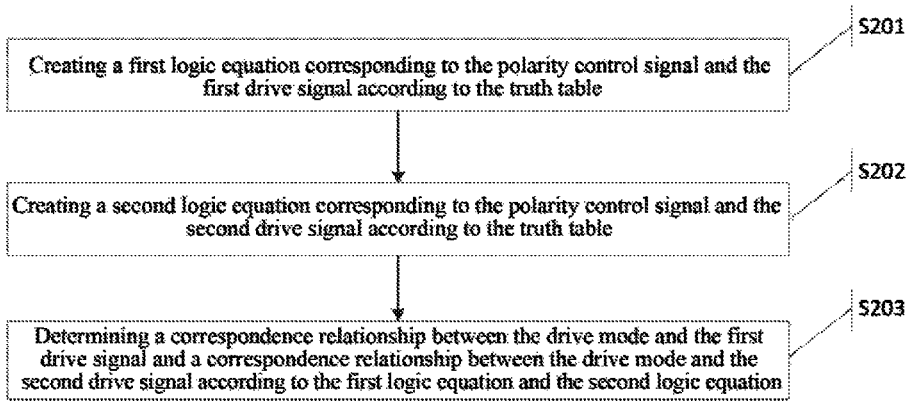
FIG. 3 is a flow chart of determining a drive signal in an embodiment of the application.

Furthermore, the particular determination manner in the step S104 particularly includes the following steps with reference to FIG. 3:

S201, creating a first logic equation corresponding to the polarity control signal and the first drive signal according to the truth table.

S202, creating a second logic equation corresponding to the polarity control signal and the second drive signal according to the truth table.

S203, determining a correspondence relationship between the drive mode and the first drive signal and a correspondence relationship between the drive mode and the second drive signal according to the first logic equation and the second logic equation.

A method for creating correspondence relationships has been described in details in the foregoing steps.

In an embodiment of the application, a liquid crystal panel is particularly driven by a gate driver and a source driver, where the gate driver is responsible for turning on and off each row of the liquid crystal panel, and the source driver is responsible for controlling data to be fed into each row of the liquid crystal panel when the row is turned on. Liquid crystal drive technologies include three drive modes, which are 1-line drive mode, 2-line drive mode and 1+2-line drive mode. The 1-line drive mode refers to level-by-level driving per row, where only one row of data of the liquid crystal panel is driven each time, for example, there are 1024 rows in the liquid crystal panel, and then 1-line driving is level-by-level driving per row, that is, each of the 1024 rows is level-by-level scanned and driven; the 2-line drive mode refers to driving every two rows, that is, each scan can drive data corresponding to two adjacent rows, for example, there are 1024 rows in the liquid crystal panel, and then 2-line driving is level-by-level driving every two rows, that is, firstly the first and second rows of data are driven concurrently, secondly the third and fourth rows of data are driven concurrently, thirdly the fifth and sixth rows of data are driven concurrently, and so on; and the 1+2-line drive mode is a special one, where a preceding row of data will also be driven each time except for the first row which is driven separately, for example, there are 1024 rows in the liquid crystal panel, and in the 1+2-line drive mode, firstly the first row of data is driven, secondly the second and third rows of data are driven, thirdly the third and fourth rows of data are driven, fourthly the fourth and fifth rows of data are driven, and so on, until all of the rows of data are scanned and driven.

The polarity control signal is a row inversion signal output from a timing controller, and for the liquid crystal panel, there are three inversion modes, which are frame inversion, row inversion and column inversion, and in the embodiment of the application, the form of row inversion is adopted, where the voltage polarity Vcom of a common terminal is changed to achieve the purpose of inversion, that is, the timing controller will output a row inversion signal POL from which Vcom is generated, and the DC terminal of Vcom is adjusted to change the color of the liquid crystal panel, and the AC terminal is adjusted to change the contrast of the liquid crystal panel.

The drive modes have different charge sharing time when corresponding polarity control signals are inverted.

By way of an example, the 1-line drive mode takes place when the polarity control signal is inverted and its charge sharing time is set to 60 clks; the 2-line drive mode may or may not take place when the polarity control signal is inverted, so charge sharing time for each inversion is different, which is 70 clks for the first inversion, 50 clks for the second inversion, 70 elks again for the third inversion and 50 elks for the fourth inversion; and the 1+2-line drive mode also may or may not take place when the polarity control signal is inverted, so charge sharing time for each inversion is different, which is 50 elks for the first inversion, 70 elks for the second inversion, 50 elks again for the third inversion and 70 elks for the fourth inversion.

In the foregoing description, different drive modes correspond to different charge sharing time, and with such a design, charging time can be supplemented for the liquid crystal panel by using the corresponding charge sharing after detecting the fixed drive mode in the liquid crystal panel.

From the foregoing analysis, the correspondence relationship between the drive modes and the time required for charge sharing in the drive mode can be determined according to the polarity control signal. As illustrated in FIG. 4A, FIG. 4A illustrates time required for charge sharing for the first three times, and in FIG. 4A, the contents of rows in the table are the three drive modes in the embodiment of the application, and the contents of columns are respective charge sharing time.

In addition, since different drive modes have different inversions of the polarity control signal upon each scan, the step S102 can be performed to create the first correspondence relationship between the polarity control signal and the drive mode in the liquid crystal display device, as illustrated in FIG. 4B, which records different inversion conditions of the polarity control signal corresponding to the different drive modes under the corresponding drive signal upon the first three scans, where the contents of rows are the three different drive modes, and the contents of columns are the inversion conditions of the polarity control signal corresponding to the different drive modes in the first three scans, wherein a high level of the polarity control signal is set to 1 and a low level thereof is set to 0.

The step S103 can be performed according to the first correspondence relationship to create the truth table corresponding to the first correspondence relationship, and the contents of the truth table are the same as the contents in FIG. 4B.

Thus the step S104 can be performed to determine the drive signal corresponding to the drive mode according to the truth table.

Wherein assumed POL1=A, POL2=B and POL3=C, then the contents in FIG. 4B can be converted into the contents in FIG. 5.

Wherein the drive signal includes the first drive signal and the second drive signal which can be determined from two scans, the contents in FIG. 5 are the correspondence relationship between the three different drive modes and the first drive signal, and the contents in FIG. 6 are the correspondence relationship between the three different drive modes and the second drive signal.

With the foregoing logic relationships, logic equations of the first drive signal and the second drive signal can be created, that is, the first logic equation is $F1=\overline{A}B+A\overline{B}$, and the second logic equation is $F2=\overline{B}C+B\overline{C}$.

The foregoing logic equations can be embodied in gate circuits, as illustrated in FIG. 7 and FIG. 8, where FIG. 7 is a gate circuit of the first logic equation, and FIG. 8 is a gate circuit of the second logic equation.

A relationship between the first drive signal and the second drive signal in the three different drive modes can be obtained from the contents of FIG. 5 to FIG. 8, as illustrated in FIG. 9, and the corresponding drive signal to be used can be determined synthetically from the first drive signal and the second drive signal.

For example, when both the first drive signal and the second drive signal of the drive signal are determined as 1, it can be determined synthetically that the drive signal corresponds to the 1-line drive mode; and when the first drive signal is 0 and the second drive signal is 1, it can be determined synthetically that the drive signal also corresponds to the 1-line drive mode.

In FIG. 9, the drive signal in the 2-line drive mode is special, and the second drive signal in the 2-line drive mode shall be calculated as 1 according to the foregoing second logic equation, but since the 2-line drive mode can be determined by determining only the first drive signal without determining the second drive signal, the drive mode can be determined as the 2-line drive mode when determining the first drive signal as 0 regardless of whether the second drive signal is 0 or 1. Thus the second drive signal in the 2-line drive mode is determined as 1 or 0 in FIG. 9.

With this architecture, different drive modes can be determined corresponding to different drive signals, and then different charging time for charge sharing can be selected according to the different drive modes, thereby solving the problem of parity lines in the prior art.

In an embodiment of the application, a drive mode is determined as follows:

Referring to FIG. 10 in which a method for determining a drive mode is shown, the method is applied to an electronic apparatus and includes the following steps:

S301, receiving a drive signal to be processed.

Furthermore, the drive signal to be processed is parsed into a first drive signal to be processed and a second drive signal to be processed after receiving the drive signal to be processed.

S302, determining a drive mode corresponding to the drive signal to be processed according to a correspondence relationship, preset in the electronic apparatus, between the drive signal and the drive mode, wherein the correspondence relationship is obtained according to the method in the foregoing embodiment.

Furthermore, the drive mode corresponding to the drive signal is determined as illustrated in FIG. 11 and particularly as follows:

S401, judging a first drive mode corresponding to the first drive signal from the correspondence relationship, preset in the electronic apparatus, between the drive signal and the drive mode.

S402, judging a second drive mode corresponding to the second drive signal from the correspondence relationship, preset in the electronic apparatus, between the drive signal and the drive mode.

S403, judging the drive mode corresponding to the drive signal from the first drive mode and the second drive mode.

Charge sharing corresponding to the drive mode can be determined according to the corresponding drive mode when determining the drive mode corresponding to the drive signal.

In the embodiment of the application, different drive modes can be determined corresponding to different drive signals, and then different charging time for charge sharing can be selected according to the different drive modes, thereby solving the problem of parity lines in the prior art.

Figure 12:
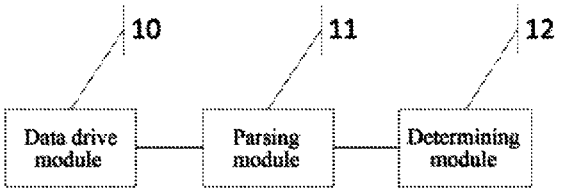
FIG. 12 is a schematic diagram of an electronic apparatus in an embodiment of the application.

In addition, referring to FIG. 12, an embodiment of the application further provides an electronic apparatus including a data drive module 10, a parsing module 11 and a determining module 12.

Wherein the data drive module 10 is configured to receive a drive signal to be processed.

Furthermore, the data drive module 10 is further configured to determine a drive mode corresponding to the drive signal to be processed according to a correspondence relationship, preset in the electronic apparatus, between the drive signal and the drive mode, where the correspondence relationship is obtained according to the method in the foregoing embodiment.

Furthermore, the parsing module 11 is configured to parse the drive signal to be processed into a first drive signal to be processed and a second drive signal to be processed.

Furthermore, the determining module 12 is configured to determine charge sharing corresponding to the drive mode according to the corresponding drive mode.

Figure 13:
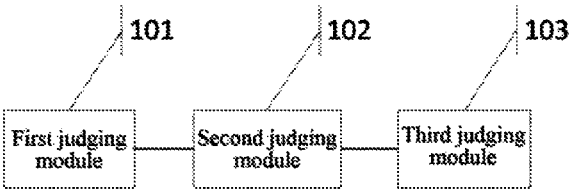
FIG. 13 is a schematic diagram of a data drive module in an embodiment of the application.

Furthermore, as illustrated in FIG. 13, the data drive module 10 particularly includes:

A first judging module 101 configured to judge a first drive mode corresponding to the first drive signal from the correspondence relationship, preset in the electronic apparatus, between the drive signal and the drive mode.

A second judging module 102 configured to judge a second drive mode corresponding to the second drive signal from the correspondence relationship, preset in the electronic apparatus, between the drive signal and the drive mode.

A third judging module 103 configured to judge the drive mode corresponding to the drive signal from the first drive mode and the second drive mode.

Figure 14:
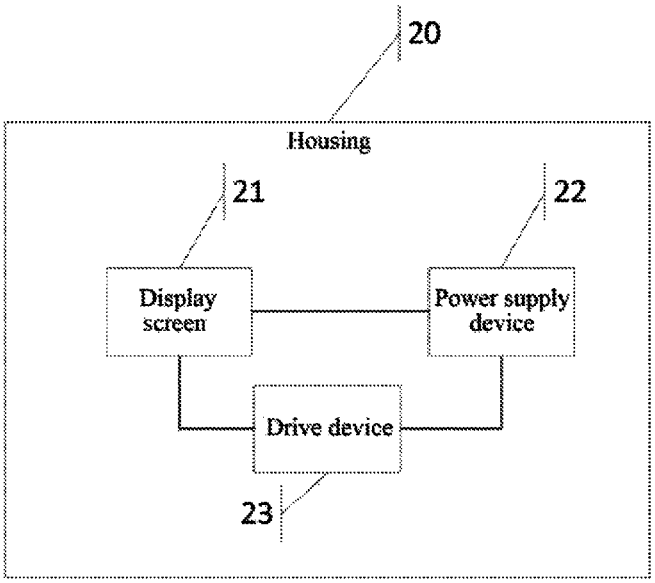
FIG. 14 is a schematic diagram of an electronic apparatus in an embodiment of the application.

Furthermore, an embodiment of the application further provides a video playing apparatus as illustrated in FIG. 14, which includes: a housing 20; a display screen 21 arranged in the housing 20; a power supply device 22, connected with the display screen 21, and configured to supply power to the display screen 21; and a drive device 23, connected with the display screen 21 and the power supply device 22, and configured to receive a drive signal to be processed and to determine a drive mode in the display screen 21 corresponding to the drive signal to be processed according to a correspondence relationship, preset in the drive device 23, between the drive signal and the drive mode, where the correspondence relationship is obtained according to the method in the foregoing embodiment.

Furthermore, the drive device 23 particularly includes: a first judging module configured to judge a first drive mode corresponding to a first drive signal from the correspondence relationship, preset in the drive device 23, between the drive signal and the drive mode; a second judging module configured to judge a second drive mode corresponding to a second drive signal from the correspondence relationship, preset in the drive device 23, between the drive signal and the drive mode; and a third judging module configured to judge the drive mode corresponding to the drive signal from the first drive mode and the second drive mode.

The following technical effects can be achieved through one or more embodiments of the invention:

In the application, a correspondence relationship between drive modes and drive signals and a correspondence relationship between different drive modes and different charge sharing corresponding thereto are created in a series of methods, and a different drive signal can be analyzed upon reception of the drive signal to determine a corresponding drive mode, and then corresponding charging time for charge sharing can be used to thereby solve the technical problem of parity lines appearing in the liquid crystal display device.

Those skilled in the art shall appreciate that the embodiments of the invention can be embodied as a method, a system or a computer program product. Therefore the invention can be embodied in the form of an all-hardware embodiment, an all-software embodiment or an embodiment of software and hardware in combination. Furthermore, the invention can be embodied in the form of a computer program product embodied in one or more computer useable storage mediums (including but not limited to a disk memory, a CD-ROM, an optical memory, etc.) in which computer useable program codes are contained.

The invention has been described with reference to flow charts and/or block diagrams of the method, the device (system) and the computer program product according to the embodiments of the invention. It shall be appreciated that respective flows and/or blocks in the flow charts and/or the block diagrams and combinations of the flows and/or the blocks in the flow charts and/or the block diagrams can be embodied in computer program instructions. These computer program instructions can be loaded onto a general-purpose computer, a specific-purpose computer, an embedded processor or a processor of another programmable data processing device to produce a machine so that the instructions executed on the computer or the processor of the other programmable data processing device create means for performing the functions specified in the flow(s) of the flow charts and/or the block(s) of the block diagrams.

These computer program instructions can also be stored into a computer readable memory capable of directing the computer or the other programmable data processing device to operate in a specific manner so that the instructions stored in the computer readable memory create manufactures including instruction means which perform the functions specified in the flow(s) of the flow charts and/or the block(s) of the block diagrams.

These computer program instructions can also be loaded onto the computer or the other programmable data processing device so that a series of operational steps are performed on the computer or the other programmable data processing device to create a computer implemented process so that the instructions executed on the computer or the other programmable device provide steps for performing the functions specified in the flow(s) of the flow charts and/or the block(s) of the block diagrams.

Although the preferred embodiments of the invention have been described, those skilled in the art benefiting from the underlying inventive concept can make additional modifications and variations to these embodiments. Therefore the appended claims are intended to be construed as encompassing the preferred embodiments and all the modifications and variations coming into the scope of the invention.

Evidently those skilled in the art can make various modifications and variations to the embodiments of the invention without departing from the spirit and scope of the embodiments of the invention. Thus the invention is also intended to encompass these modifications and variations thereto so long as these modifications and variations come into the scope of the claims appended to the invention and their equivalents.

The invention claimed is:

1. A signal processing method, applied to an electronic apparatus provided with or externally connected with a liquid crystal display device, the method comprising:

receiving a polarity control signal;

obtaining a first correspondence relationship between the polarity control signal and a drive mode in the liquid crystal display device according to the polarity control signal;

creating a truth table corresponding to the first correspondence relationship according to the first correspondence relationship; and determining a drive signal corresponding to the drive mode according to the truth table, wherein the drive signal comprises a first drive signal and a second drive signal;

wherein determining the drive signal corresponding to the drive mode according to the truth table comprises:

creating a first logic equation corresponding to the polarity control signal and the first drive signal according to the truth table;

creating a second logic equation corresponding to the polarity control signal and the second drive signal according to the truth table; and determining a correspondence relationship between the drive mode and the first drive signal and a correspondence relationship between the drive mode and the second drive signal according to the first logic equation and the second logic equation.

2. The method according to claim 1, wherein, after receiving the polarity control signal, further comprising:

determining a correspondence relationship between the drive mode and time required for charge sharing in the drive mode according to the polarity control signal.

3. The method according to claim 1, wherein the truth table is a correspondence relationship between the drive mode and the drive signal.

4. A method of determining a drive mode, applied to an electronic apparatus, the method comprising:

receiving a drive signal to be processed; and determining a drive mode corresponding to the drive signal to be processed according to a correspondence relationship, preset in the electronic apparatus, between the drive signal and the drive mode, wherein the correspondence relationship is obtained according to the method of claim 1.

5. The method according to claim 4, wherein after receiving the drive signal to be processed, the method further comprises:

parsing the drive signal to be processed into a first drive signal to be processed and a second drive signal to be processed.

6. The method according to claim 5, wherein determining the drive mode corresponding to the drive signal according to the correspondence relationship, preset in the electronic apparatus, between the drive signal and the drive mode comprises:

judging a first drive mode corresponding to the first drive signal from the correspondence relationship, preset in the electronic apparatus, between the drive signal and the drive mode;

judging a second drive mode corresponding to the second drive signal from the correspondence relationship, preset in the electronic apparatus, between the drive signal and the drive mode; and judging the drive mode corresponding to the drive signal from the first drive mode and the second drive mode.

7. The method according to claim 6, wherein, after judging the drive mode corresponding to the drive signal, further comprising:

determining charge sharing corresponding to the drive mode according to the corresponding drive mode.

8. An electronic apparatus comprising:

a data drive module configured to receive a drive signal to be processed; and the data drive module further configured to determine a drive mode corresponding to the drive signal to be processed according to a correspondence relationship, preset in the electronic apparatus, between the drive signal and the drive mode, wherein the correspondence relationship is obtained according to the method of claim 1.

9. The electronic apparatus according to claim 8, further comprising:

a parsing module configured to parse the drive signal to be processed into a first drive signal to be processed and a second drive signal to be processed.

10. The electronic apparatus according to claim 9, wherein the data drive module comprises:

a first judging module configured to judge a first drive mode corresponding to the first drive signal from the correspondence relationship, preset in the electronic apparatus, between the drive signal and the drive mode;

a second judging module configured to judge a second drive mode corresponding to the second drive signal from the correspondence relationship, preset in the electronic apparatus, between the drive signal and the drive mode; and a third judging module configured to judge the drive mode corresponding to the drive signal from the first drive mode and the second drive mode.

11. The electronic apparatus according to claim 10, further comprising:

a determining module configured to determine charge sharing corresponding to the drive mode according to the corresponding drive mode.

12. A video playing apparatus comprising:

a housing;

a display screen arranged in the housing;

a power supply device, connected with the display screen, and configured to supply power to the display screen; and a drive device, connected with the display screen and the power supply device, and configured to receive a drive signal to be processed and to determine a drive mode in the display screen corresponding to the drive signal to be processed according to a correspondence relationship, preset in the drive device, between the drive signal and the drive mode, wherein the correspondence relationship is obtained according to the method of claim 1.

13. The video playing apparatus according to 12, wherein the drive device comprises:

a first judging module configured to judge a first drive mode corresponding to a first drive signal from the correspondence relationship, preset in the drive device, between the drive signal and the drive mode;

a second judging module configured to judge a second drive mode corresponding to a second drive signal from the correspondence relationship, preset in the drive device, between the drive signal and the drive mode; and a third judging module configured to judge the drive mode corresponding to the drive signal from the first drive mode and the second drive mode.

14. A video playing apparatus comprising:

a memory; and one or more processors, wherein the memory stores computer-readable program codes, and the one or more processors are used to execute the computer-readable program codes to implement:

pre-establishing a first correspondence relationship table reflecting a correspondence relationship between each of row inversion drive modes and values taken for three consecutive polarity control signals in that row inversion drive mode, wherein the row inversion drive modes comprise 1 line drive mode, 2 line drive mode and 1+2 line drive mode, and each of the row inversion drive modes corresponds to a charge sharing time;

pre-establishing a truth table reflecting a correspondence relationship between each of the row inversion drive modes and each pair of values taken for two driving signals in that row inversion drive mode, wherein the values taken for the two driving signals in that row inversion drive mode are results of logic operations performed respectively under a first logic equation and a second logic equation on the values taken for the three consecutive polarity control signals in that row inversion drive mode;

in a process of image displaying, obtaining current pair of values of the two driving signals by performing the logical operations respectively under the first logic equation and the second logic equation on current values of the three consecutive polarity control signals received in the process of image displaying;

searching out a current drive mode corresponding to the current pair of values of the two driving signals from the truth table; and determining a current charge sharing time corresponding to the current drive mode.

15. The apparatus according to claim 14, wherein the two driving signals are a first driving signal and a second driving signal, a value of the first driving signal is a result of a logic operation performed under the first logic equation on values of first two of the three consecutive polarity control signals; and a value of the second driving signal is a result of a logic operation performed under the second logic equation on values of last two of the three consecutive polarity control signals.

16. The apparatus according to claim 14, wherein the first logic equation is $F1=\overline{A}B+A\overline{B}$;

the second logic equation is $F2=\overline{B}C+B\overline{C}$;

F1 represents the value of the first driving signal;

F2 represents the value of the second driving signal;

A and B represent the values of the first two of the three consecutive polarity control signals; and B and C represent the values of the last two of the three consecutive polarity control signals.

* * * * *